US011393398B2

(12) United States Patent
Lee

(10) Patent No.: US 11,393,398 B2
(45) Date of Patent: Jul. 19, 2022

(54) GAMMA VOLTAGE GENERATING DEVICE AND DISPLAY DEVICE INCLUDING THE SAME

(71) Applicant: SILICON WORKS CO., LTD., Daejeon (KR)

(72) Inventor: Dong Su Lee, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/167,532

(22) Filed: Feb. 4, 2021

(65) Prior Publication Data

US 2021/0256909 A1 Aug. 19, 2021

(30) Foreign Application Priority Data

Feb. 14, 2020 (KR) ..... 10-2020-0018485

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2310/027* (2013.01); *G09G 2310/0291* (2013.01); *G09G 2320/0673* (2013.01)

(58) Field of Classification Search
CPC ..... G09G 3/3258
USPC ..... 345/690
See application file for complete search history.

(56) References Cited

U.S. PATENT DOCUMENTS

2013/0271507 A1* 10/2013 Kim ..... G09G 3/3291 345/690
2014/0111402 A1* 4/2014 Kim ..... G09G 3/3225 345/76
2020/0211457 A1* 7/2020 Kim ..... G09G 3/3275
2021/0201801 A1* 7/2021 Lee ..... G09G 3/3258

FOREIGN PATENT DOCUMENTS

KR 10-2018-0078935 A 7/2018
KR 10-2019-0067672 A 6/2019
KR 10-2110584 B1 5/2020

* cited by examiner

*Primary Examiner* — Long D Pham
(74) *Attorney, Agent, or Firm* — Fenwick & West LLP

(57) ABSTRACT

The present disclosure allows removal of the influence by an unstable pixel power voltage by generating or selectively using a gamma voltage according to a gamma reference voltage variable depending on the level of the pixel power voltage.

14 Claims, 6 Drawing Sheets

GAMMA VOLTAGE GENERATING DEVICE AND DISPLAY DEVICE INCLUDING THE SAME

CROSS REFERENCE TO RELATED APPLICATION

This application claims priority from Republic of Korea Patent Application No. 10-2020-0018485, filed on Feb. 14, 2020, which is hereby incorporated by reference in its entirety.

BACKGROUND

1. Field of Technology

The present disclosure relates to a technique for generating a gamma voltage for driving a pixel in a display device.

2. Description of the Prior Art

A display device may comprise a panel, a gate driving device, a data driving device, and a timing controller. A data driving device may receive image data from a data processing device, convert the image data into an analog signal, for example a data voltage, and transmit it to a panel.

A data driving device may comprise a digital-to-analog converter (DAC), which converts image data into an analog signal. A digital-to-analog converter may output one of a plurality of gamma voltages as an analog signal according to image data. A plurality of gamma voltages may respectively have fixed levels different from each other.

A plurality of pixels comprised in a panel may be provided with power for being driven. However, a resistance in a power supply line may decrease the level of a voltage supplied to a pixel. For this reason, each pixel may not be provided with uniform power and thus each pixel may not emit light of a desired brightness. Consequently, the brightness of each pixel may be different from the others.

A plurality of gamma voltages respectively having fixed levels may not contribute to reduction of the brightness differences among pixels due to resistances in lines. In a situation where power supplied to a pixel varies, if a plurality of gamma voltages or a gamma reference voltage to generate a plurality of gamma voltages have a fixed level in order to compensate variable power, the pixel may not be driven by a targeted level of analog voltage and may not emit light with a targeted brightness.

In addition, an unstable power supply to pixels may cause flicker or wave noises in terms of an image quality and may aggravate the deterioration of pixels. Also, a frequent fluctuation of the power level may increase the power consumption.

SUMMARY

The present disclosure is to provide a technique for generating a corrected gamma voltage in order to resolve the instability of a voltage for driving a pixel.

An aspect of the present disclosure is to provide a technique for selectively supplying a gamma voltage of a fixed level or a gamma voltage variable depending on the level of a pixel power voltage.

Another aspect of the present disclosure is to provide a technique for receiving a pixel power voltage, generating a gamma reference voltage depending on the level of the pixel power voltage, and generating a plurality of gamma voltages depending on the level of the pixel power voltage from the gamma reference voltage.

To this end, in an aspect, the present disclosure provides a gamma voltage generating device, which generates gamma voltages for driving pixels, comprising: a first voltage generating circuit to generate a first gamma reference voltage; a second voltage generating circuit to generate a second gamma reference voltage, wherein the level of the second gamma reference voltage is adjusted according to the level of a pixel power voltage supplied to a pixel; and a gamma voltage generating circuit to generate gamma voltages from one selected among the first gamma reference voltage or the second gamma reference voltage.

The first gamma reference voltage may be regulated to a fixed level.

The gamma voltage generating circuit may receive a top level of voltage and a bottom level of voltage and generate gamma voltages by distributing voltages between the top level of voltage and the bottom level of voltage. The first gamma reference voltage may be either the top level of voltage or the bottom level of voltage.

The pixel may comprise an organic light emitting diode and a driving transistor connected with each other in series, the pixel power voltage may supply power to the organic light emitting diode, and one selected from the gamma voltages according to a grayscale value of the pixel may be supplied through a gate node of the driving transistor.

The pixel power voltage may be supplied through a source node of the driving transistor.

In an another aspect, the present disclosure provides a gamma voltage generating device, which generates gamma voltages for driving pixels, comprising: a voltage generating circuit to generate a first gamma reference voltage and a second gamma reference voltage of which levels are adjusted according to a level of a pixel power voltage supplied to a pixel; and a gamma voltage generating circuit to receive the first gamma reference voltage as a top level of voltage and the second gamma reference voltage as a bottom level of voltage and to generate gamma voltages by distributing voltages between the top level of voltage and the bottom level of voltage.

The voltage generating circuit may receive one reference voltage and reflect the pixel power voltage in the one reference voltage to generate the first gamma reference voltage or the second gamma reference voltage.

The voltage generating circuit may generate the first gamma reference voltage by summing up the one reference voltage and the pixel power voltage.

The voltage generating circuit may comprise a first gamma reference voltage circuit to generate the first gamma reference voltage and the first gamma reference voltage circuit may comprise a first amplifier to receive the one reference voltage and the pixel power voltage through an input terminal.

The voltage generating circuit may receive another reference voltage and generate the second gamma reference voltage by obtaining a difference between the other reference voltage and the pixel power voltage.

The voltage generating circuit may comprise a second gamma reference voltage circuit to generate the second gamma reference voltage and the second gamma reference voltage circuit may comprise a second amplifier to receive the other reference voltage through an input terminal and the pixel power voltage through another input terminal.

The second gamma reference voltage circuit may comprise a differential amplifier.

The voltage generating circuit may comprise a first gamma reference voltage circuit to generate the first gamma reference voltage and the first gamma reference voltage circuit may comprise a non-inverting adding circuit comprising a first amplifier and four resistances.

The voltage generating circuit may comprise a second gamma reference voltage circuit to generate the second gamma reference voltage and the second gamma reference voltage circuit may comprise a differential amplifying circuit comprising a second amplifier and four resistances.

The pixel may comprise an organic light emitting diode and a driving transistor connected with each other in series, the pixel power voltage may supply power to the organic light emitting diode, and one selected from the gamma voltages according to a grayscale value of the pixel may be supplied through a gate node of the driving transistor.

As described above, the present disclosure allows removing an influence of an unstable pixel power voltage by generating or selectively using a gamma voltage according to a gamma reference voltage variable depending on the pixel power voltage.

In addition, since the influence of an unstable pixel power voltage is removed, the present disclosure allows decreasing the probability of flickers, wave noises, and deterioration of pixels and thus improving the image quality.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
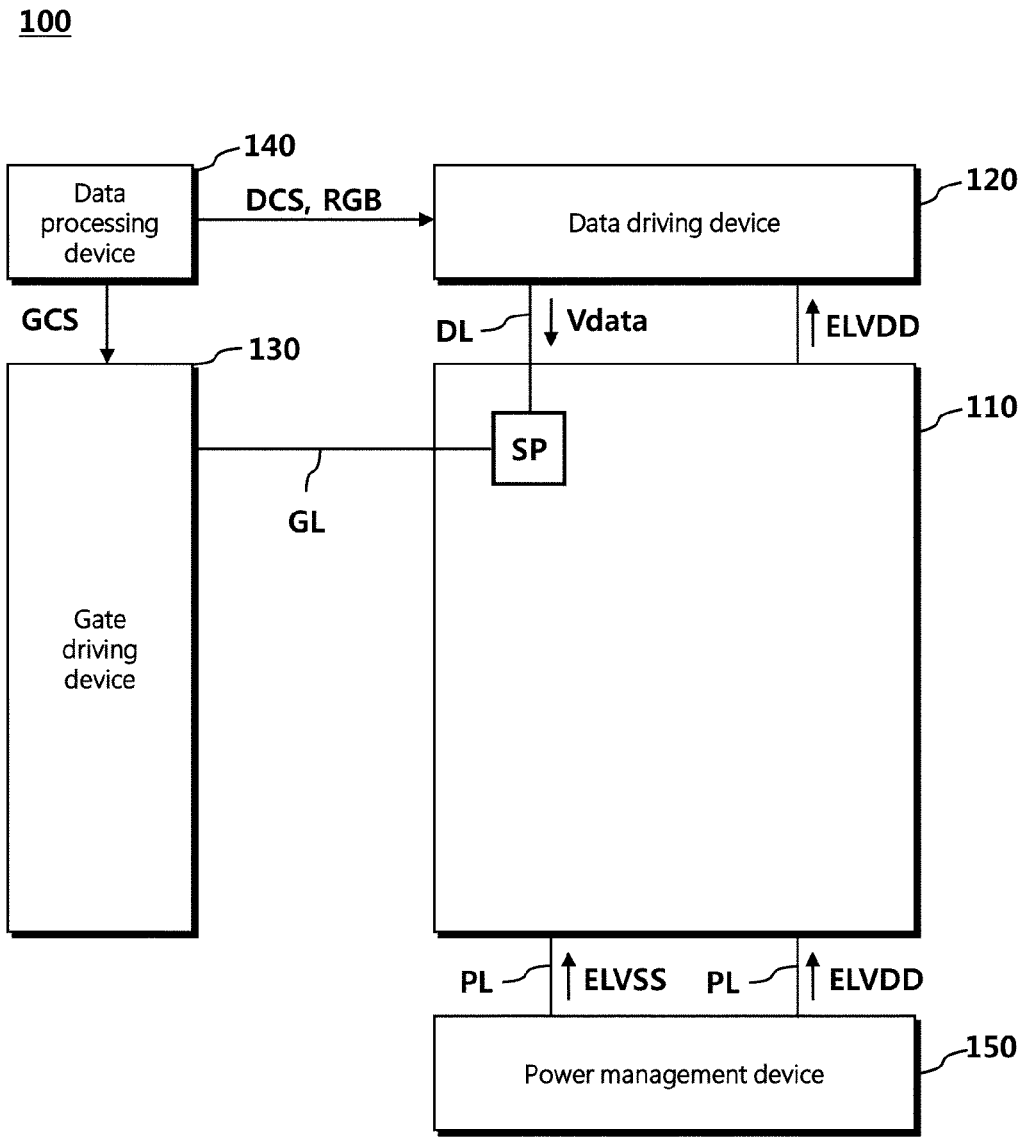
FIG. 1 is a configuration diagram of a display device according to an embodiment.

FIG. 1 is a configuration diagram of a display device according to an embodiment.

Referring to FIG. 1, a display device 100 may comprise a panel 110, a data driving device 120, a gate driving device 130, and a data processing device 140.

On the panel 110, a plurality of data lines DL and a plurality of gate lines GL may be disposed and a plurality of pixels P may also be disposed. A pixel P may comprise a plurality of sub-pixels. Here, a sub-pixel may be a red (R) sub-pixel, a green (G) sub-pixel, a blue (B) sub-pixel, or a white (W) sub-pixel. A pixel may comprise RGB sub-pixels, RGBG sub-pixels, or RGBW sub-pixels. Hereinafter, for the convenience of description, the description will be made supposing that a pixel P comprises RGB sub-pixels and various signals are transmitted to a pixel P without distinguishing sub-pixels will be described.

The data driving device 120, the gate driving device 130, and the data processing device 140 generate signals for displaying an image on the panel 110.

The gate driving device 130 may supply a gate driving signal, such as a turn-on voltage or a turn-off voltage, through a gate line GL. When a gate driving signal of a turn-on voltage is supplied to a pixel P, the pixel P is connected with a data line DL. When a gate driving signal of a turn-off voltage is supplied to a pixel P, the pixel P is disconnected from the data line DL. A gate driving device 130 may be referred to as a gate driver.

The data driving device 120 may supply a data voltage Vdata to a pixel P through a data line DL. A data voltage Vdata supplied through a data line DL may be supplied to a pixel P according to a gate driving signal. A data driving device 120 may be referred to as a source driver.

The data driving device 120 may generate a plurality of gamma voltages and selects one of the plurality of gamma voltages to output a data voltage Vdata corresponding to image data RGB. The data driving device 120 may comprise a digital-to-analog converter and a buffer. The digital-to-analog converter may select one of the plurality of gamma voltages according to image data RGB and outputs the selected one voltage to the buffer. The buffer may amplify the selected one voltage and apply the voltage as a data voltage Vdata to a pixel P through a data line DL.

The data driving device 120 may comprise at least one integrated circuit, and this at least one integrated circuit may be connected to a bonding pad of a display panel 110 in a tape automated bonding (TAB) type or a chip-on-glass (COG) type, directly formed on a display panel 110, or integrated on a display panel 110 depending on cases. In addition, a data driving device 120 may be formed in a chip-on-film (COF) type.

The data processing device 140 may supply control signals to the gate driving device 130 and the data driving device 120. For example, the data processing device 140 may transmit a gate control signal GCS to initiate a scan to the gate driving device 130, output image data to the data driving device 120, and transmit a data control signal DCS to control the data driving device 120 to supply a data voltage Vdata to each pixel P. The data processing device 140 may be referred to as a timing controller.

The power management device 150 may supply power to the panel 110, the data driving device 120, the gate driving device 130, and the data processing device 140. The power management device 150 may generate voltages, each having a level required for each circuit such as a DC-DC converter.

The power management device 150 may supply pixel power voltages ELVDD, ELVSS to pixels of the panel 110 so as to drive the pixels P. The pixel power voltages ELVDD, ELVSS may comprise a first pixel power voltage ELVDD and a second pixel power voltage ELVSS of a lower level than that of the first pixel power voltage ELVDD.

The first pixel power voltage ELVDD may also be transmitted to the data driving device 120. The pixel power voltages ELVDD, ELVSS are supplied through power lines PL. When a pixel P is distant from the power management device 150, a resistance in a power line PL may increase. An increase of a resistance in a power line PL may decrease levels of pixel power voltages ELVDD, ELVSS supplied to a pixel P. As a distance between a pixel P and the power management device 150 increases, the reduction of a voltage level may be greater. In particular, the first pixel power voltage ELVDD may be affected by a resistance in a power line PL. Accordingly, the data driving device 120 may receive the first pixel power voltage ELVDD from a pixel and generate a corrected gamma voltage in order to remove the influence of the decreased level of the first pixel power voltage ELVDD due to the resistance in the power line PL.

Figure 2:
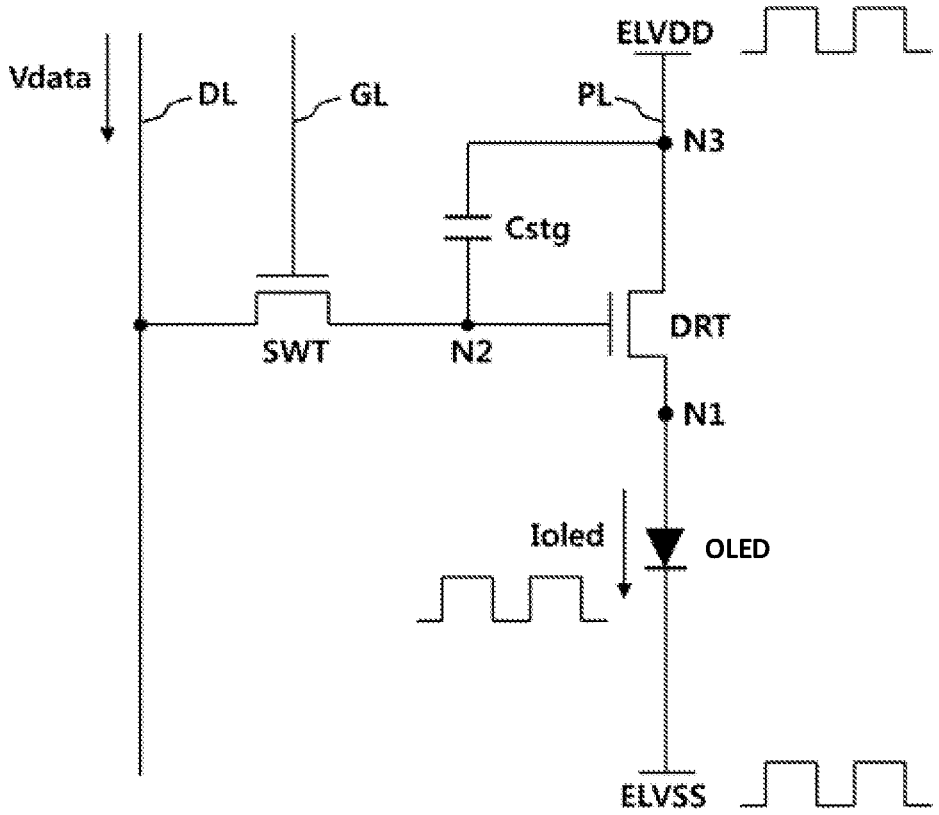
FIG. 2 is a circuit diagram showing a structure of a pixel and signals inputted into or outputted from the pixel according to an embodiment.

FIG. 2 is a circuit diagram showing a structure of a pixel and signals inputted into or outputted from the pixel.

Referring to FIG. 2, a pixel P may comprise an organic light emitting diode OLED, a driving transistor DRT, a switching transistor SWT, and a storage capacitor Cstg. When pixel power voltages ELVDD, ELVSS are supplied to the pixel P, a first pixel power voltage ELVDD may be supplied in a direction of an anode electrode of the organic light emitting diode OLED and a second pixel power voltage ELVSS may be supplied in a direction of a cathode electrode of the organic light emitting diode OLED.

The organic light emitting diode OLED may comprise an anode electrode, an organic layer, and a cathode electrode. The organic light emitting diode OLED may emit light by connecting the anode electrode with the first pixel power voltage ELVDD and the cathode electrode with a base voltage, that is, the second pixel power voltage ELVSS according to the control of the driving transistor DRT.

The driving transistor DRT may control the brightness of the organic light emitting diode OLED by controlling the level of a driving current Ioled supplied to the organic light emitting diode OLED. Since the pixel power voltages ELVDD, ELVSS have periodic waves having uniform pulses, the driving current Ioled may also have a periodic wave.

A first node N1 of the driving transistor DRT may be electrically connected with the anode electrode of the organic light emitting diode OLED and may be a source node or a drain node. A second node N2 of the driving transistor DRT may be electrically connected with a source node or a drain node of the switching transistor SWT and may be a gate node. A third node N3 of the driving transistor DRT may be electrically connected with a power line PL through which the first pixel power voltage ELVDD is supplied and may be a drain node or a source node.

The switching transistor SWT may be electrically connected between a data line DL and the second node N2 of the driving transistor DRT and may be turned on by a scan signal supplied through a gate line GL.

When the switching transistor SWT is turned on, a data voltage Vdata, supplied from the data driving circuit 120 through the data line DL, may be transmitted to the second node N2 of the driving transistor DRT.

The storage capacitor Cstg may be electrically connected between the second node N2 and the third node N3 of the driving transistor DRT.

The storage capacitor Cstg may be a parasitic capacitor present between the second node N2 and the third node N3 of the driving transistor DRT or an outer capacitor intentionally disposed outside the driving transistor DRT.

Figure 3:
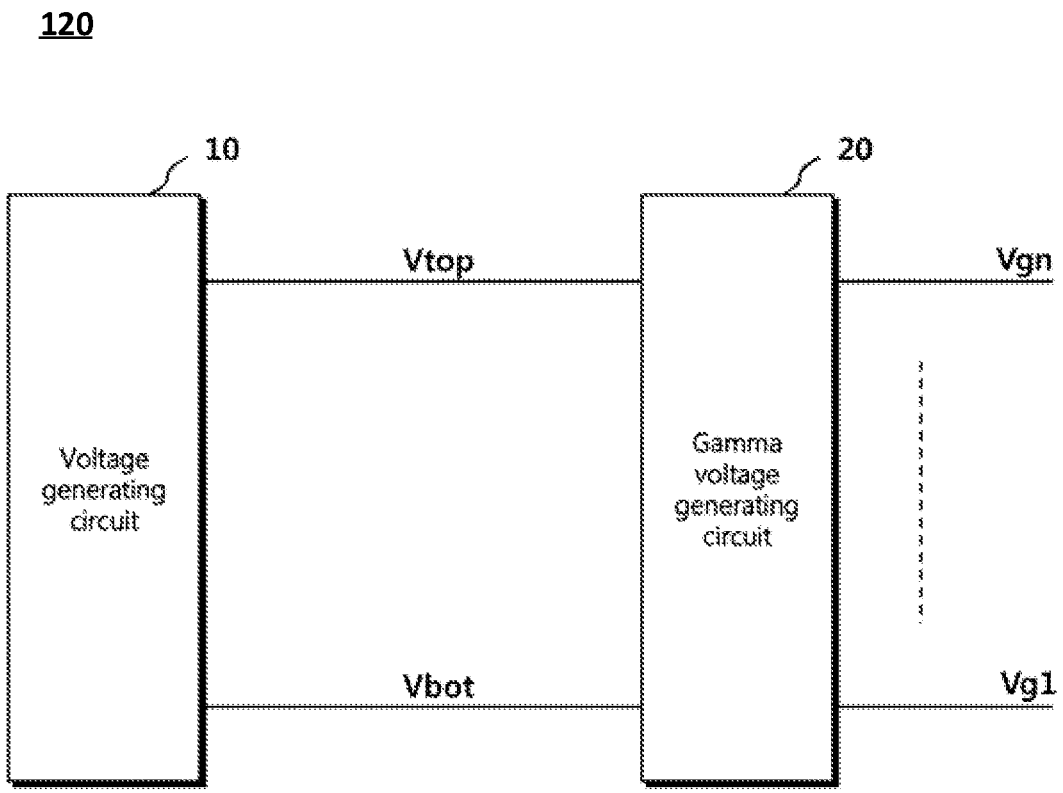
FIG. 3 is a configuration diagram of a gamma voltage generating device of a data driving device according to an embodiment.

FIG. 3 is a configuration diagram of a gamma voltage generating device of a data driving device 120.

Referring to FIG. 3, a gamma voltage generating device 1 may comprise a voltage generating circuit 10 and a gamma voltage generating circuit 20.

The voltage generating circuit 10 may generate at least two gamma reference voltages, that is, a top level of voltage Vtop and a bottom level of voltage Vbot, for generating gamma voltages Vg1-Vgn and transmit the two gamma reference voltages to the gamma voltage generating circuit 20. Here, the top level of voltage Vtop may have a higher level than that of the bottom level of voltage Vbot and the top level of voltage Vtop and the bottom level of voltage Vbot may respectively be regulated to fixed levels.

The gamma voltage generating circuit 20 may generate gamma voltages Vg1-Vgn. The gamma voltage generating circuit 20 may receive the top level of voltage Vtop and the bottom level of voltage Vbot and generate gamma voltages Vg1-Vgn by distributing voltages between the top level of voltage Vtop and the bottom level of voltage Vbot. The gamma voltage generating circuit 20 may comprise a resistor string in which a plurality of resistances are connected with each other in series. The resistor string may distribute voltages between the top level of voltage Vtop and the bottom level of voltage Vbot. The resistor string may be referred to as a voltage divider. A plurality of resistances constituting the resistor string form nodes at points where the resistances are connected with each other and the gamma voltages Vg1-Vgn may be formed respectively at the nodes. Since a node is formed at every point where two adjacent resistances are connected, a plurality of gamma voltages Vg1-Vgn may be generated.

The data driving device 1 may select one of the plurality of gamma voltages Vg1-Vgn, amplify the selected one, and output it as a data voltage.

Figure 4:
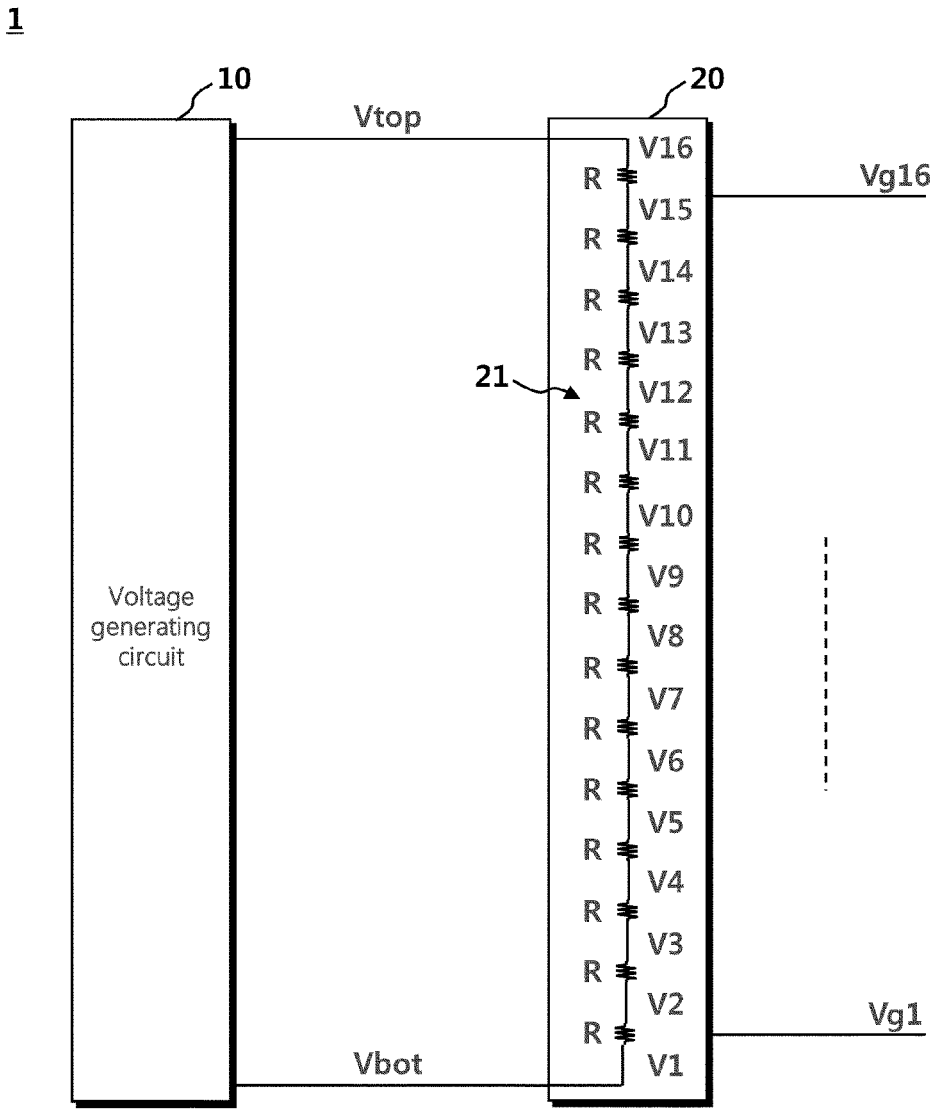
FIG. 4 is a circuit diagram of a gamma voltage generating circuit of a gamma voltage generating device according to an embodiment.

FIG. 4 is a circuit diagram of a gamma voltage generating circuit of a gamma voltage generating device 1.

Referring to FIG. 4, as an example, the gamma voltage generating circuit 20 may comprise a resistor string for generating 16 gamma voltages Vg1-Vg16.

The gamma voltage generating circuit 20 may comprise a resistor string 21. The resistor string 21 may comprise a plurality of resistances connected with each other in series. The resistor string 21 may also comprise nodes formed by the connection of the plurality of resistances between two ends. The nodes may comprise points where the resistances are connected, one end of the resistor string to which the top level of voltage is applied, and the other end of the resistor string to which the bottom level of voltage is applied. In this figure, the resistances comprised in the gamma voltage generating circuit 20 are indicated by R.

In the resistor string 21, voltages between the top level of voltage Vtop and the bottom level of voltage Vbot may be distributed by the plurality of resistances in series so that node voltages may be formed in the respective nodes. Node voltages V1-V16 formed in the 16 nodes may be outputted as 16 gamma voltages Vg1-Vg16.

Figure 5:
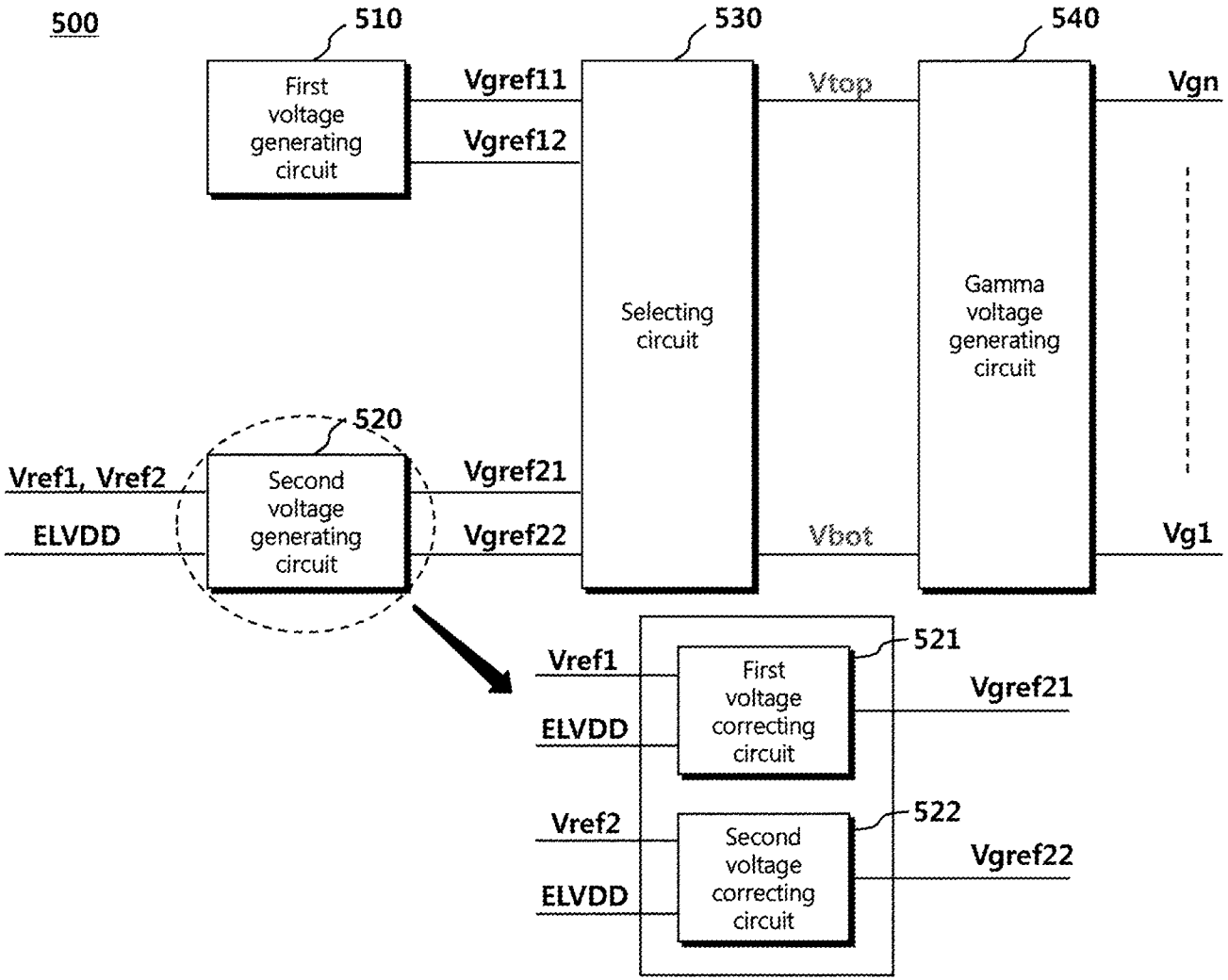
FIG. 5 is a configuration diagram of a gamma voltage generating device of a data driving device according to an embodiment.

FIG. 5 is a configuration diagram of a gamma voltage generating device 500 of a data driving device according to an embodiment.

Referring to FIG. 5, a gamma voltage generating device 500 according to an embodiment may comprise a first voltage generating circuit 510, a second voltage generating circuit 520, a selecting circuit 530, and a gamma voltage generating circuit 540.

The gamma voltage generating device 500 may generate gamma voltages for driving pixels. The gamma voltage generating device 500 may generate gamma voltages Vg1-Vgn using first gamma reference voltages Vgref11, Vgref12 regulated to a fixed level regardless of the levels of pixel power voltages ELVDD, ELVSS or using second gamma reference voltages Vgref21, Vgref22 having levels variable depending on the levels of the pixel power voltages ELVDD, ELVSS. In other words, the gamma voltage generating device 500 may generate the gamma voltages Vg1-Vgn selectively using the first gamma reference voltages Vgref11, Vgref12 or the second gamma reference voltages Vgref21, Vgref22.

In FIG. 5, an example, in which the gamma voltage generating device 500 generates the second gamma reference voltages Vgref21, Vgref22 linked with a first pixel power voltage ELVDD, will be described.

The first voltage generating circuit 510 may generate the first gamma reference voltages Vgref11, Vgref12 regulated to a fixed level. The first gamma reference voltages Vgref11, Vgref12 may comprise a 1-1$^{st}$ gamma reference voltage Vgref11 and a 1-2$^{nd}$ gamma reference voltage Vgref12. When the selecting circuit 530 selects the first gamma reference voltages Vgref11, Vgref12, the 1-1$^{st}$ gamma reference voltage Vgref11 may be inputted into the gamma voltage generating circuit 540 as a top level of voltage Vtop and the 1-2$^{nd}$ gamma reference voltage Vgref12 may be inputted into the gamma voltage generating circuit 540 as a bottom level of voltage Vbot.

The second voltage generating circuit 520 may generate the second gamma reference voltages Vgref21, Vgref22 having different levels depending on the level of the first pixel power voltage ELVDD. The second gamma reference voltages Vgref21, Vgref22 may comprise a 2-1$^{st}$ gamma reference voltage Vgref21 and a 2-2$^{nd}$ gamma reference voltage Vgref22. When the selecting circuit 530 selects the second gamma reference voltages Vgref21, Vgref22, the 2-1$^{st}$ gamma reference voltage Vgref21 may be inputted into the gamma voltage generating circuit 540 as a top level of voltage Vtop and the 2-2$^{nd}$ gamma reference voltage Vgref22 may be inputted into the gamma voltage generating circuit 540 as a bottom level of voltage Vbot.

In order to generate the second gamma reference voltages Vgref21, Vgref22 variable depending on the level of the first pixel power voltage ELVDD, the second voltage generating circuit 520 may reflect the first pixel power voltage ELVDD.

Specifically, the second voltage generating circuit 520 may receive the first reference voltage Vref1 or the second reference voltage Vref2 and generate the 2-1$^{st}$ gamma reference voltage Vgref21 or the 2-2$^{nd}$ gamma reference voltage Vgref22 by reflecting the first pixel power voltage ELVDD in the received reference voltage Vref1, Vref2.

The second voltage generating circuit 520 may generate the 2-1$^{st}$ gamma reference voltage Vgref21 by adding the first pixel power voltage ELVDD to the first reference voltage Vref1. The second voltage generating circuit 520 may comprise a first gamma reference voltage circuit to generate the 2-1$^{st}$ gamma reference voltage Vgref21. The first gamma reference voltage circuit may comprise an amplifier receiving the first reference voltage Vref1 and the first pixel power voltage ELVDD through an input terminal.

In addition, the second voltage generating circuit 520 may generate the 2-2$^{nd}$ gamma reference voltage Vgref22 by obtaining a difference between the second reference voltage Vref2 and the first pixel power voltage ELVDD. The second voltage generating circuit 520 may comprise a second gamma reference voltage circuit to generate the 2-2$^{nd}$ gamma reference voltage Vgref22. The second gamma reference voltage circuit may comprise an amplifier receiving the second reference voltage Vref2 through one input terminal and the first pixel power voltage ELVDD through another input terminal. Here, the amplifier comprised in the second gamma reference voltage circuit may be a differential amplifier.

The second voltage generating circuit 520 may comprise a first voltage correcting circuit 521 and a second voltage correcting circuit 522 to respectively generate the 2-1$^{st}$ gamma reference voltage Vgref21 and the 2-2$^{nd}$ gamma reference voltage Vgref22.

The first voltage correcting circuit 521 may receive the first pixel power voltage ELVDD and generate the 2-1$^{st}$ gamma reference voltage Vgref21 variable depending on the level of the first pixel power voltage ELVDD. Accordingly, the first voltage correcting circuit 521 may be the first gamma reference voltage circuit. Since the first voltage correcting circuit 521 may generate the 2-1$^{st}$ gamma reference voltage Vgref21 reflecting the first pixel power voltage ELVDD, the 2-1$^{st}$ gamma reference voltage Vgref21 may vary as the first pixel power voltage ELVDD varies due to the resistance in the power line. The 2-1$^{st}$ gamma reference voltage Vgref21 may be inputted into the gamma voltage generating circuit 540 as a top level of voltage Vtop.

The second voltage correcting circuit 522 may receive the first pixel power voltage ELVDD and generate the 2-2$^{nd}$ gamma reference voltage Vgref22 variable depending on the level of the first pixel power voltage ELVDD. Accordingly, the second voltage correcting circuit 522 may be the second gamma reference voltage circuit. Since the second voltage correcting circuit 522 may generate the 2-2$^{nd}$ gamma reference voltage Vgref22 reflecting the first pixel power voltage ELVDD, the 2-2$^{nd}$ gamma reference voltage Vgref22 may vary as the first pixel power voltage ELVDD varies due to the resistance in the power line. The 2-2$^{nd}$ gamma reference voltage Vgref22 may be inputted into the gamma voltage generating circuit 540 as a bottom level of voltage Vbot.

The selecting circuit 530 may select one set of the first gamma reference voltages Vgref11, Vgref12 and the second gamma reference voltages Vgref21, Vgref22. The selecting circuit 530 may transmit the selected gamma reference voltages to the gamma voltage generating circuit 540 as a top level of voltage Vtop and a bottom level of voltage Vbot.

The gamma voltage generating circuit 540 may receive the gamma reference voltages, selected by the selecting circuit 530, as a top level of voltage Vtop and a bottom level of voltage Vbot and generate a plurality of gamma voltages Vg1-Vgn. The gamma voltage generating circuit 540 may generate a plurality of gamma voltages respectively having different levels by distributing voltages between the selected gamma reference voltages.

For example, the gamma voltage generating circuit 540 may generate the plurality of gamma voltages Vg1-Vgn by distributing voltages between the 1-1$^{st}$ gamma reference voltage Vgref11 and the 1-2$^{nd}$ gamma reference voltage Vgref12 or by distributing voltages between the 2-1$^{st}$ gamma reference voltage Vgref21 and the 2-2$^{nd}$ gamma reference voltage Vgref22.

According to an embodiment of the present disclosure, when the level of the first pixel power voltage ELVDD varies, the second voltage generating circuit 520 generates the gamma reference voltages Vgref21, Vgref22 immediately corrected according to the variation of the level of the first pixel power voltage ELVDD after receiving the first pixel power voltage ELVDD. Since the variation of the level of the pixel power voltage is reflected in real time, the gamma reference voltages may be more accurately corrected.

In addition, since the gamma voltages are generated or selectively used according to the gamma reference voltage variable depending on the level of the pixel power voltage, the influence by the unstable pixel power voltage may be removed and this allows decreasing the probability of flickers, wave noises, and deterioration of pixels and thus improving the image quality.

Figure 6:
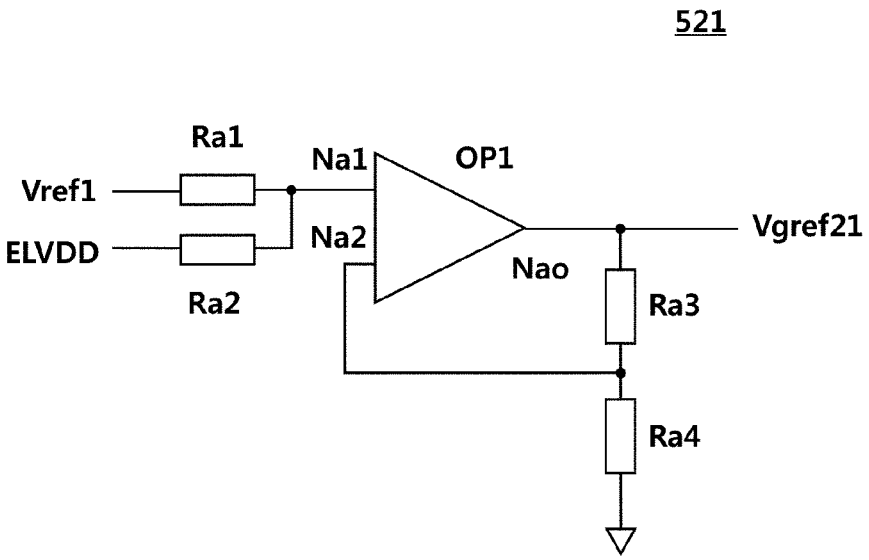
FIG. 6 is a configuration diagram of a first voltage correcting circuit according to an embodiment.

FIG. 6 is a configuration diagram of a first voltage correcting circuit 521 according to an embodiment.

Referring to FIG. 6, the first voltage correcting circuit 521 may comprise a first amplifier OP1 and four resistances Ra1-Ra4.

The first amplifier OP1 and the four resistances Ra1-Ra4 may form a non-inverting adding circuit.

A first resistance Ra1 may be provided with a first reference voltage Vref1 through its one side and may be connected with a first input terminal Na1 of the first amplifier OP1 in its other side.

A second resistance Ra2 may be provided with a first pixel power voltage ELVDD through its one side and may be connected with the first input terminal Na1 of the first amplifier OP1 in its other side.

A third resistance Ra3 may be connected with an output terminal Nao of the first amplifier OP1 in its one side and may be connected with a second input terminal Na2 of the first amplifier OP1 in its other side.

A fourth resistance Ra4 may be connected with the second input terminal Na2 of the first amplifier OP1 in its one side and with a ground in its other side.

The four resistances Ra1-Ra4 may have the same impedance value.

In this case, a (Vref1+ELVDD)/2 of voltage may be formed in the first input terminal Na1 and a Vref1+ELVDD of voltage may be formed in the output terminal Nao.

According to such a relation, the 2-1$^{st}$ gamma reference voltage Vgref21 may be equal to a sum of the first reference voltage Vref1 and the first pixel power voltage ELVDD.

Figure 7:
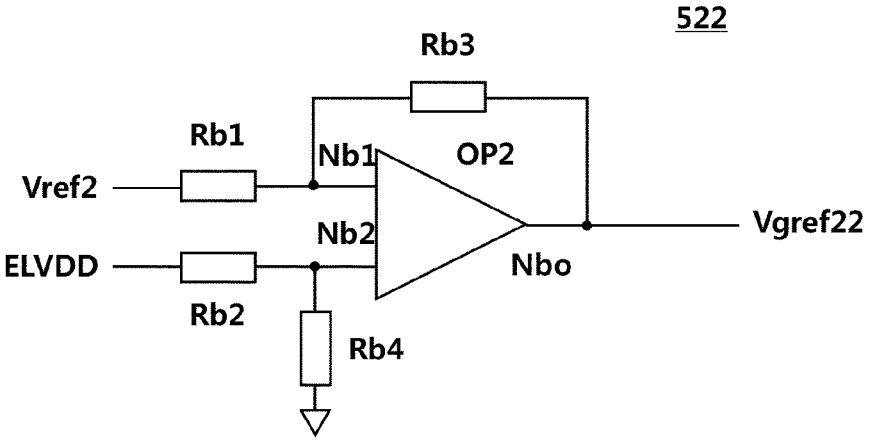
FIG. 7 is a configuration diagram of a second voltage correcting circuit according to an embodiment.

FIG. 7 is a configuration diagram of a second voltage correcting circuit 522 according to an embodiment.

Referring to FIG. 7, a second voltage correcting circuit 522 may comprise a second amplifier OP2 and four resistances Rb1-Rb4.

The second amplifier OP2 and the four resistances Rb1-Rb4 may form a differential amplifying circuit.

A first resistance Rb1 may be provided with a second reference voltage Vref2 through its one side and may be connected with a first input terminal Nb1 of the second amplifier OP2 in its other side.

A second resistance Rb2 may be provided with a first pixel power voltage ELVDD through its one side and may be connected with a second input terminal Nb2 of the second amplifier OP2 in its other side.

A third resistance Rb3 may be connected with an output terminal Nbo of the second amplifier OP2 in its one side and may be connected with the first input terminal Nb1 of the second amplifier OP2 in its other side.

A fourth resistance Rb4 may be connected with the second input terminal Nb2 of the second amplifier OP2 in its one side and with a ground in its other side.

The four resistances Rb1-Rb4 may have the same impedance value.

In this case, in the output terminal Nbo, a voltage obtained by subtracting the second reference voltage Vref2 from the pixel power voltage ELVDD may be formed.

While the disclosure has been particularly shown and described with reference to one embodiment and several alternate embodiments, it will be understood by persons skilled in the relevant art that various changes in form and details can be made therein without departing from the spirit and scope of the invention.

What is claimed is:

1. A gamma voltage generating device, which generates gamma voltages for driving pixels, comprising:

a first voltage generating circuit to generate first gamma reference voltages comprising a first top gamma reference voltage and a first bottom gamma reference voltage;

a second voltage generating circuit to generate second gamma reference voltages comprising a second top gamma reference voltage and a second bottom gamma reference voltage, wherein a level of each of the second gamma reference voltages is adjusted according to a level of a pixel power voltage supplied to a pixel; and a gamma voltage generating circuit to generate gamma voltages from gamma reference voltages selected between the first gamma reference voltages and the second gamma reference voltages, wherein the second voltage generating circuit receives the pixel power voltage from a panel on which the pixel is disposed.

2. The gamma voltage generating device of claim 1, wherein the first gamma reference voltages are regulated to a fixed level regardless of the pixel power voltage.

3. The gamma voltage generating device of claim 2, wherein the gamma voltage generating circuit receives a top level of voltage and a bottom level of voltage, and generates the gamma voltages by distributing voltages between the top level of voltage and the bottom level of voltage, and the first gamma reference voltage is one of the top level of voltage or the bottom level of voltage.

4. The gamma voltage generating device of claim 1, wherein the pixel comprises an organic light emitting diode and a driving transistor connected to the organic light emitting diode in series, the pixel power voltage supplies power to the organic light emitting diode, and one selected from the gamma voltages according to a grayscale value of the pixel is supplied to a gate node of the driving transistor.

5. The gamma voltage generating device of claim 4, wherein the pixel power voltage is supplied to a source node of the driving transistor.

6. The gamma voltage generating device of claim 1, wherein the gamma voltage generating circuit receives the first top gamma reference voltage or the second top gamma reference voltage as a top level of voltage and the first bottom gamma reference voltage or the second bottom gamma reference voltage as a bottom level of voltage, and to generate gamma voltages by distributing voltages between the top level of voltage and the bottom level of voltage, and wherein the voltage generating circuit receives the pixel power voltage from a panel on which the pixel is disposed.

7. The gamma voltage generating device of claim 6, wherein the voltage generating circuit receives one reference voltage and reflects the pixel power voltage in the one reference voltage to generate the second top gamma reference voltage or the second bottom gamma reference voltage.

8. The gamma voltage generating device of claim 7, wherein the voltage generating circuit generates the second top gamma reference voltage by summing the one reference voltage and the pixel power voltage.

9. The gamma voltage generating device of claim 8, wherein the voltage generating circuit comprises a first gamma reference voltage circuit to generate the second top gamma reference voltage and the second top gamma reference voltage circuit comprises a first amplifier to receive the one reference voltage and the pixel power voltage through an input terminal.

10. The gamma voltage generating device of claim 8, wherein the voltage generating circuit comprises a first gamma reference voltage circuit to generate the second top gamma reference voltage and the first gamma reference voltage circuit comprises a non-inverting adding circuit comprising a first amplifier and four resistances.

11. The gamma voltage generating device of claim 7, wherein the voltage generating circuit receives another reference voltage and generates the second bottom gamma reference voltage by obtaining a difference between the other reference voltage and the pixel power voltage.

12. The gamma voltage generating device of claim 11, wherein the voltage generating circuit comprises a second gamma reference voltage circuit to generate the second bottom gamma reference voltage and the second gamma reference voltage circuit comprises a second amplifier to receive the other reference voltage through an input terminal and the pixel power voltage through another input terminal.

13. The gamma voltage generating device of claim 12, wherein the second gamma reference voltage circuit comprises a differential amplifier.

14. The gamma voltage generating device of claim 11, wherein the voltage generating circuit comprises a second gamma reference voltage circuit to generate the second bottom gamma reference voltage and the second gamma reference voltage circuit comprises a differential amplifying circuit comprising a second amplifier and four resistances.

* * * * *